US012703531B2

(12) United States Patent
Hofmann et al.

(10) Patent No.: US 12,703,531 B2
(45) Date of Patent: Aug. 11, 2026

(54) METHOD AND DEVICE FOR MONITORING A FILLING AND/OR CLOSING INSTALLATION AND/OR POST-PROCESSING INSTALLATION

(71) Applicant: OPTIMA pharma GmbH, Schwäbisch Hall (DE)

(72) Inventors: Matthias Hofmann, Ilshofen (DE); Waldemar Mayer, Schwäbisch Hall (DE); Matthias Poslovski, Schwäbisch Hall (DE); Thomas Pospiech, Erlenbach (DE); Jürgen Rothbauer, Michelfeld (DE); Julian Schweigert, Schwäbisch Hall (DE); Florian Weippert, Schwäbisch Hall (DE)

(73) Assignee: OPTIMA pharma GmbH, Schwäbisch Hall (DE)

( * ) Notice: Subject to any disclaimer, the term of this patent is extended or adjusted under 35 U.S.C. 154(b) by 0 days.

(21) Appl. No.: 18/687,229

(22) PCT Filed: Sep. 22, 2022

(86) PCT No.: PCT/EP2022/076378
§ 371 (c)(1),
(2) Date: Feb. 27, 2024

(87) PCT Pub. No.: WO2023/046834
PCT Pub. Date: Mar. 30, 2023

(65) Prior Publication Data

US 2024/0383630 A1 Nov. 21, 2024

(30) Foreign Application Priority Data

Sep. 27, 2021 (DE) ..... 102021210749.4

(51) Int. Cl.
*B65B 3/06* (2006.01)
*B65B 3/00* (2006.01)
*B65B 57/14* (2006.01)

(52) U.S. Cl.
CPC ..... *B65B 57/14* (2013.01); *B65B 3/006* (2013.01)

(58) Field of Classification Search
None
See application file for complete search history.

(56) References Cited

U.S. PATENT DOCUMENTS

2010/0013500 A1* 1/2010 Maher ..... G01N 27/22 324/663
2011/0019877 A1 1/2011 Kasemann et al.
(Continued)

FOREIGN PATENT DOCUMENTS

CN 104192370 A 12/2014
CN 111568230 A 8/2020
(Continued)

OTHER PUBLICATIONS

Notice of Reasons for Rejection issued Jan. 7, 2025 in connection with corresponding Japanese Patent Application No. 2024-542233.
(Continued)

*Primary Examiner* — Chinyere J Rushing-Tucker
(74) *Attorney, Agent, or Firm* — Blank Rome

(57) ABSTRACT

The invention relates to a method and a device for monitoring a filling and/or closing installation and/or a post-processing installation, in particular for the pharmaceutical industry, wherein an image of a transport, infeed and/or outfeed region (2, 3, 6) of the filling and/or closing and/or post-processing installation is taken using a camera system (10) and, wherein on the basis of the image, by use of an artificial intelligence model (AI model) (120) that is trained
(Continued)

to detect primary packaging means in the transport, infeed and/or outfeed region (2, 3, 6) and to classify detected primary packaging means, it is determined in which image positions primary packaging means are present, and detected primary packaging means are assigned to a class. The invention further relates to a filling and/or closing installation and/or post-processing installation and to a computer program for monitoring a filling and/or closing installation and/or post-processing installation.

21 Claims, 5 Drawing Sheets

(56) References Cited

U.S. PATENT DOCUMENTS

| | | | | |
|---|---|---|---|---|
| 2020/0097724 | A1* | 3/2020 | Chakravarty | G06V 10/82 |
| 2021/0048421 | A1 | 2/2021 | Da Silva | |
| 2022/0314433 | A1 | 10/2022 | Rietzler et al. | |

FOREIGN PATENT DOCUMENTS

| | | | |
|---|---|---|---|
| CN | 112874906 | A | 6/2021 |
| CN | 112960213 | A | 6/2021 |
| CN | 112977974 | A | 6/2021 |
| DE | 10 2007 047 877 | A1 | 6/2009 |
| JP | 2020045132 | A | 3/2020 |
| JP | 2021020811 | A | 2/2021 |
| JP | 2021-077126 | A | 5/2021 |
| JP | 2021-160787 | A | 10/2021 |

OTHER PUBLICATIONS

Horputra Pinkaew et al: "Deep Learning-Based Bottle Caps Inspection in Beverage Manufacturing and Packaging Process," 2021 9th International Electrical Engineering Congress, IEEE, Mar. 10, 2021, pp. 499 and 501.

International Search Report issued Dec. 16, 2022 in connection with PCT/EP2022/076378.

Written Opinion of the International Searching Authority issued Dec. 16, 2022 in connection with PCT/EP2022/076378.

* cited by examiner

METHOD AND DEVICE FOR MONITORING A FILLING AND/OR CLOSING INSTALLATION AND/OR POST-PROCESSING INSTALLATION

CROSS-REFERENCE TO RELATED APPLICATIONS

This application is a national phase of PCT/EP2022/076378, filed Sep. 22, 2022, and claims priority to DE 102021210749.4, filed Sep. 27, 2021, the entire contents of both of which are hereby incorporated by reference.

FIELD OF APPLICATION AND PRIOR ART

The invention relates to a method and a device for monitoring a filling and/or closing installation and/or a post-processing installation, in particular for the pharmaceutical industry. The invention further relates to a filling and/or closing installation and/or post-processing installation and to a computer program for monitoring a filling and/or closing installation and/or post-processing installation.

Filling and/or closing installations for the pharmaceutical industry are used for filling liquid or powder-form pharmaceutical and biopharmaceutical products into containers such as small bottles (vials), infusion bottles, carpules, disposable syringes or the like, the containers being closed by means of a closure such as, for example, a stopper and/or a cap, as far as possible immediately after filling and any subsequent inspection. In the context of the application, containers and closures are referred to as primary packaging means. Post-processing installations are used, for example, for inspection, labelling, repackaging or other handling of the filled, and usually already closed, primary packaging means.

Filling of sensitive or hazardous products in this case is usually performed in an isolator. In addition, installations without an isolator for filling or post-processing of pharmaceuticals and/or other products are also known.

Disturbances or faults in the process flow of filling and closing and/or of post-processing can result in stoppage of the installation. However, particularly when small batches are processed in a filling and/or closing installation and/or a post-processing installation, it is highly desirable to avoid stoppage times if possible. Moreover, an unplanned stoppage of a filling and/or closing installation and/or post-processing installation can have the consequence that the products can no longer be used. This applies in particular-but not exclusively-to sensitive biopharmaceutical products.

OBJECT AND SOLUTION

Objects of the invention are to provide a method and a device for automated monitoring of a filling and/or closing installation and/or post-processing installation, in particular for the pharmaceutical industry. Further objects are to provide a filling and/or closing installation and/or post-processing installation having an automated monitoring system and a computer program for automated monitoring of a filling and/or closing installation and/or post-processing installation.

These objects are achieved by the subjects having the features of claims 1, 8, 13 and 14. Further advantageous embodiments result from the dependent claims.

According to a first aspect a method for monitoring a filling and/or closing and/or post-processing installation, in particular for the pharmaceutical industry, is provided, wherein an image of a transport, infeed and/or outfeed region of the filling and/or closing and/or post-processing installation is taken using a camera system and, wherein on the basis of the image, by use of an artificial intelligence model (AI model) that is trained to detect primary packaging means and classify detected primary packaging means, it is determined in which image positions primary packaging means are present, and detected primary packaging means are assigned to a class.

In the context of the application, the terms "a" and "an" are used as indefinite articles and not as counting terms. In particular, it is provided in embodiments that not a single image, but a sequence of images is taken and evaluated for continuous monitoring of the transport, infeed and/or outfeed region.

Depending on the application, one camera system or a plurality of camera systems is/are provided at the filling and/or closing and/or post-processing installation.

Evaluation of the image, or the images of a sequence of images, by use of an AI model renders possible automated monitoring of a transport, infeed and/or outfeed region without prior knowledge of a location and/or time of occurrence of primary packaging means in the monitored region.

Further, the AI model is used in this case to assign detected primary packaging means to a class.

For classification of the primary packaging means, in an embodiment, classes are defined in advance by an expert according to a particular application. In an embodiment, it is provided in this regard that different types of primary packaging means can be detected, with a class being allocated to each type. In an embodiment, detected objects that cannot be assigned to a class are marked.

Alternatively or additionally, in an embodiment, primary packaging means of a type are classified on the basis of their orientation. In an embodiment, in this regard primary packaging means that are fed correctly oriented, overturned in the transport direction, overturned transversely to the transport direction, twisted and/or upside down are differentiated for classification.

In an embodiment, the AI model is an artificial neural network. In particular, in embodiments, the AI model is a deep learning artificial neural network, commonly referred to as a deep neural network.

Training data for the AI model may be generated in advance for typical transport, infeed and/or outfeed regions and for different primary packaging means, and the AI model trained accordingly. In advantageous embodiments, at least one improvement of a pre-trained AI model is effected on the basis of training data for a particular transport, infeed and/or outfeed region and a particular primary packaging means and/or in consideration of typical environmental parameters, in order thus to increase the reliability of the monitoring.

In an embodiment, it is provided that the results of the monitoring are logged, in particular electronically logged. Data to be logged in this case can be suitably specified by the person skilled in the art, according to the application. In an embodiment, the logging in this case also serves to check the monitoring by use of the AI model. In an embodiment, logged states together with suitably prepared image files serve as training data for the AI model.

In an embodiment, an output of the AI model is evaluated by use of a rule-based algorithm for the purpose of determining disturbances.

In the context of the application, a rule-based algorithm is an algorithm that performs an evaluation of the determined disturbance on the basis of rules and information that can be suitably specified in advance by the person or expert skilled in the art. In this regard, the method uses expert knowledge about particular transport, infeed and/or outfeed regions and/or particular primary packaging means and/or other boundary conditions.

In the context of the application, the term "disturbances" is generally used to describe an irregularity in a process flow, wherein, depending on the embodiment, the disturbance has already led to a stoppage of the installation or a disturbance in the process flow, the disturbance is detected and handled, in particular rectified, before a stoppage of the installation or a disturbance in the process flow occurs, and/or the disturbance has no influence on the immediate process flow. In an embodiment, the disturbance may be an irregularity in a transport or an infeed or outfeed of the primary packaging means, for example an incorrectly oriented primary packaging means, a missing primary packaging means or an excess primary packaging means. In an embodiment, a presence check of primary packaging means is provided, for example, to determine whether primary packaging means are present in an infeed region in a sufficient quantity and/or whether no primary packaging means are present in an outfeed region, so that it is possible to deposit primary packaging means in this region. An unplanned presence or absence of primary packaging means is referred to as a disturbance.

When a disturbance is determined, appropriate measures can be taken, depending on the application. In a simple embodiment, any determined disturbance results in a shutdown of the installation until the disturbance is handled manually or in an automated manner.

In advantageous embodiments, a determined disturbance is classified, i.e. assigned to a class, and/or prioritised, i.e. a priority value is assigned to the determined disturbance, by use of a rule-based algorithm. In an embodiment, the same rule-based algorithm is used for classification and prioritisation as for determining the disturbance, in which case, in an embodiment, determining, classifying and prioritising the disturbance are effected in one program run. In other embodiments, separate algorithms are provided, which are at least partially executed one after the other. For a classification of the disturbance, classes corresponding to a specific application are defined, in particular in advance by an expert. In an embodiment, it is then specified, on the basis of a classification, how the determined disturbance is handled. For a prioritisation, priority values for determined disturbances are in particular defined in advance by an expert, according to a specific application. In an embodiment, it is then specified, on the basis of the prioritisation, whether-and if so, when-the determined disturbance is handled. Owing to the classification and/or prioritisation it is possible to react situationally to the determined disturbance, in particular also to a plurality of disturbances that occur with a time overlap.

In an embodiment, only the fact that a disturbance has occurred is detected, without the disturbance being located in the real environment. In advantageous embodiments, it is provided that a position of a determined disturbance in the transport, infeed and/or outfeed region is identified. In an embodiment, the position in this case is defined by coordinates that allow the detected disturbance to be located in the monitored area. In other words, the location of the disturbance is detected so that the disturbance can then be handled by an operator or in an automated manner.

In an embodiment, it is provided that the monitored transport, infeed and/or outfeed region has a transport and/or sorting means for primary packaging means, in particular a transport, infeed and/or outfeed region, having a sorting bin and/or having one path or having a plurality of paths for stoppers or containers, being monitored. In an embodiment, the detected primary packaging means are classified by the AI model according to their orientation. In this case blockages in the transport, infeed and/or outfeed region, missing, incorrectly oriented and/or incorrectly positioned primary packaging means are detected as disturbances. Incorrectly oriented primary packaging means in this case are primary packaging means that have fallen over, are twisted, or are fed upside down, which can cause an error and/or a stoppage in further processing. The term "incorrectly positioned primary packaging means" is used for primary packaging means that are in a position other than an intended position. In an embodiment, blockages in the infeed region are detected indirectly, wherein a gap resulting from the blockage, i.e. an absence of primary packaging means in one position, is identified. Alternatively or additionally, in an embodiment, filled or unfilled primary packaging means and/or primary packaging means of different types are distinguished by a classification of the AI model.

Alternatively or additionally, in an embodiment, primary packaging means are provided or deposited in the monitored transport, infeed and/or outfeed region in an unordered manner or ordered in a matrix (nest), wherein in particular a spatially delimited tray for primary packaging means or a nest, from which primary packaging means are taken out, or into which primary packaging means are placed, is monitored. In an embodiment, the primary packaging means in this case are classified by the AI model according to their orientation. Alternatively or additionally, in an embodiment, filled or unfilled primary packaging means and/or primary packaging means of different types are differentiated by a classification of the AI model. In this case missing, overlying, incorrectly oriented and/or incorrectly positioned primary packaging means are detected as disturbances. Primary packaging means that rest on other primary packaging means or a nest or the like are referred to as overlying primary packaging means.

In advantageous embodiments, the camera system for monitoring the transport, infeed and/or outfeed region is arranged above the transport, infeed and/or outfeed region, offset from the transport, infeed and/or outfeed region in such a manner that a primary air supply to the transport, infeed and/or outfeed region is not disturbed by the camera system, an optical axis of the camera system being inclined with respect to a vertical axis. In the context of the application, primary air supply means an air supply from a source or a filter, in particular a high-efficiency particulate air filter (HEPA filter), in a unidirectional air flow that is at least substantially particle-free.

Depending on the application, a marginal influence on the primary air supply is tolerable, or any influence that can be determined by known measuring methods is classified as a disturbance in the primary air supply. In particular for the processing of sensitive products in an isolator or under a fume cupboard, contamination is to be prevented by an at least almost exclusive primary air supply to the primary packaging means and the components of the installation that come into contact with the primary packaging means. The camera system is therefore attached in such a manner, at least in such applications, that the primary air supply to the transport, infeed and/or outfeed region is not disturbed.

In an embodiment, if a disturbance is determined in the infeed and/or outfeed region, possibly with a corresponding classification or prioritisation of the disturbance, a signal is emitted to an operator, by which the disturbance is to be handled. In an embodiment, the operator manually handles the disturbance. In an embodiment, manual handling in the case of an isolator is effected by means of gloved interventions.

In an advantageous embodiment, a determined disturbance is handled using a manipulator, the manipulator being movable by means of a central machine controller, a decentralised manipulator controller and/or by means of a manually operable controller for the purpose of handling the determined disturbance. In an embodiment, the manipulator is arranged in an isolator housing. In an embodiment, in order to prevent the manipulator from colliding with components of the installation or with primary packaging means, interference contours of the environment are defined. In this case, path planning for an autonomous movement of the manipulator is effected in such a manner that a planned path does not cross the interference contours. In the case of a manually operable controller, an approach to positions along paths that cross the interference contours, or to positions within an interference contour, is prevented. In an embodiment, in this case virtual interference contours are also defined in order to prevent the approaching or crossing of positions that influence process safety.

In an embodiment, the manipulator comprises a gripper, in particular a servo gripper, a vacuum gripper, a pneumatic gripper and/or a magnetically driven gripper. In an embodiment, objects of different sizes can be gripped using the gripper, it being possible to detect by means of a current consumption and/or a position whether the object, in particular a primary packaging means, has been gripped. In another embodiment, tactile sensors are provided on the gripper, by means of which it is detected whether an object has been gripped. In yet other embodiments, monitoring is effected using a camera system.

Depending on the application, the manipulator has another handling means instead of a gripper, for example a passive handling means such as a hook.

In an embodiment, it is provided that in the handling region of a distal end of the manipulator, in particular of a gripper of the manipulator, no interference contour, or only a minimal interference contour of the environment is provided. In an embodiment, in order to avoid a collision of the distal end of the gripper with an environment, virtual distance sensors are provided in this case at the distal end, which are configured to sense a distance of the distal end in relation to the environment, in a digital image of the moving manipulator and the environment. In an embodiment, it is provided in this case, in particular for a visualisation for controlling the movement on a monitor and/or for a movement of the manipulator by means of a manually operable controller, that a speed of the manipulator decreases with decreasing distance. The decreasing speed increases a sensitivity for the movement of the manipulator. In order to approximate a digital image of the environment to the real environment, it is provided in an embodiment that the manipulator senses individual points of the real environment using suitable sensors, in particular using laser sensors, and synchronises the digital environment with the real environment. In order to generate a digital image of the environment, in an embodiment it is provided that the manipulator senses the real environment using suitable sensors, in particular using laser sensors.

According to a second aspect, a device for monitoring a filling and/or closing installation and/or post-processing installation, in particular for the pharmaceutical industry, is provided, comprising a camera system configured to take an image of a transport, infeed and/or outfeed region of the filling and/or closing installation and/or post-processing installation, and a computing unit comprising an artificial intelligence model (AI model) that is trained to detect primary packaging means in the transport, infeed and/or outfeed region and to classify detected primary packaging means, the computing unit being configured to determine on the basis of the image, by use of the AI model, in which image positions primary packaging means are present, and to assign detected primary packaging means to a class.

In an embodiment, the AI model is trained to assign primary packaging means to a class on the basis of their type, and/or primary packaging means of a type on the basis of their orientation.

In an embodiment, the computing unit comprises a multiplicity of subunits operating in parallel, which are arranged centrally or in a decentralised manner, and which in particular can perform different processes in parallel.

The device can be attached to a filling and/or closing installation and/or post-processing installation. In an embodiment, the filling and/or closing installation and/or post-processing installation comprises an isolator housing, in an embodiment at least the camera of the device being arranged in the isolator housing. In other embodiments, the camera is attached outside the isolator housing. In an embodiment, the computing unit is part of a control means of the filling and/or closing installation and/or post-processing installation. In other embodiments, a separate computing unit is provided, the separate computing unit in advantageous embodiments being in communication with the control means of the filling and/or closing installation and/or post-processing installation for exchange of data.

In an embodiment, the computing unit is configured to evaluate an output of the AI model by use of a rule-based algorithm for the purpose of determining disturbances.

In an embodiment, when a disturbance is determined, the computing unit sends a signal to an operator so that the operator can react accordingly. Alternatively or additionally, the computing unit sends a signal to the control means of the filling and/or closing installation and/or post-processing installation so that the control means can completely or partially stop the filling and/or closing installation and/or post-processing installation and/or slow down a process.

In advantageous embodiments, the computing unit is configured to classify and/or prioritise a determined disturbance by use of a rule-based algorithm, the computing unit being in particular configured to specify, on the basis of a classification of the disturbance, how the determined disturbance is to be handled and/or to specify, on the basis of a prioritisation, whether, and if so, when, the determined disturbance is to be handled.

In advantageous embodiments, an optical axis of the camera system is inclined with respect to a vertical axis, such that the camera system can be arranged above the monitored transport, infeed and/or outfeed region, offset from the monitored transport, infeed and/or outfeed region in such a manner that a primary air supply to the transport, infeed and/or outfeed region is not disturbed. The device is therefore also suitable for monitoring a transport, infeed and/or outfeed region of a filling and/or closing installation and/or post-processing installation for filling sensitive pharmaceutical products, in particular in an isolator.

In an embodiment, the device comprises a manipulator, which is configured to handle a determined disturbance by means of a central machine controller, a decentralised manipulator controller or by means of a manually operable controller. In an embodiment, the manually operable controller is an input device known as a game-pad, having a control pad, as is known for controlling computer games. In other embodiments, the manually operable controller is a mobile communication terminal device, such as a smartphone or tablet computer, on which an application for controlling the manipulator is provided. In yet other embodiments, a conventional control device for a machine controller, having arrow keys, is provided for movement of the manipulator. In an embodiment, the control is effected remotely from the filling and/or closing installation and/or post-processing installation, whereby a real image of the filling and/or closing installation and/or post-processing installation, acquired using a camera system, and/or a virtual image of the filling and/or closing installation and/or post-processing installation, can be displayed to the operator on a monitor. Alternatively or additionally, it is provided in an embodiment that a determined disturbance can be handled in an automated manner by the manipulator by means of a machine controller. In an embodiment, it is provided in this regard that determination and rectification are effected without intervention by an operator. In other embodiments, automated rectification is effected following enabling by the operator.

According to a third aspect, a filling and/or closing installation and/or post-processing installation comprising a transport, infeed and/or outfeed region and a device for monitoring the filling and/or closing installation and/or post-processing installation is provided. In an embodiment, the filling and/or closing installation and/or post-processing installation comprises an isolator housing in which the transport, infeed and/or outfeed region is arranged. In an embodiment, at least the camera system of the device for monitoring is also arranged in the isolator housing. In advantageous embodiments, the camera system in this case is arranged above the transport, infeed and/or outfeed region, offset from the transport, infeed and/or outfeed region in such a manner that a primary air supply to the transport, infeed and/or outfeed region is not disturbed.

According to a fourth aspect, a computer program is provided that comprises instructions that, when the program is executed by a computing unit, cause the latter to determine, on the basis of an image of a transport, infeed and/or outfeed region of a filling and/or closing and/or post-processing installation, by use of an artificial intelligence model (AI model) that is trained to detect primary packaging means in the transport, infeed and/or outfeed region and to classify detected primary packaging means, in which image positions primary packaging means are present, and to assign detected primary packaging means to a class.

In an embodiment, the computer program in this case is installed on a control means of the filling and/or closing installation and/or post-processing installation. In other embodiments, the computer program is installed on a separate desktop, notebook or tablet computer or a cloud server, wherein monitoring may be performed in the immediate vicinity of and/or remote from the filling and/or closing installation and/or post-processing installation.

In an embodiment, the computer program comprises instructions that, when the program is executed by the computing unit, cause the latter to determine, on the basis of an output of the AI model, by use of a rule-based algorithm, whether there is a disturbance present.

BRIEF DESCRIPTION OF THE DRAWINGS

Further advantages and aspects of the invention will become apparent from the claims and from the description of exemplary embodiments of the invention, which are explained below with reference to the figures, in which:

DETAILED DESCRIPTION OF THE EXEMPLARY EMBODIMENTS

Figure 1:
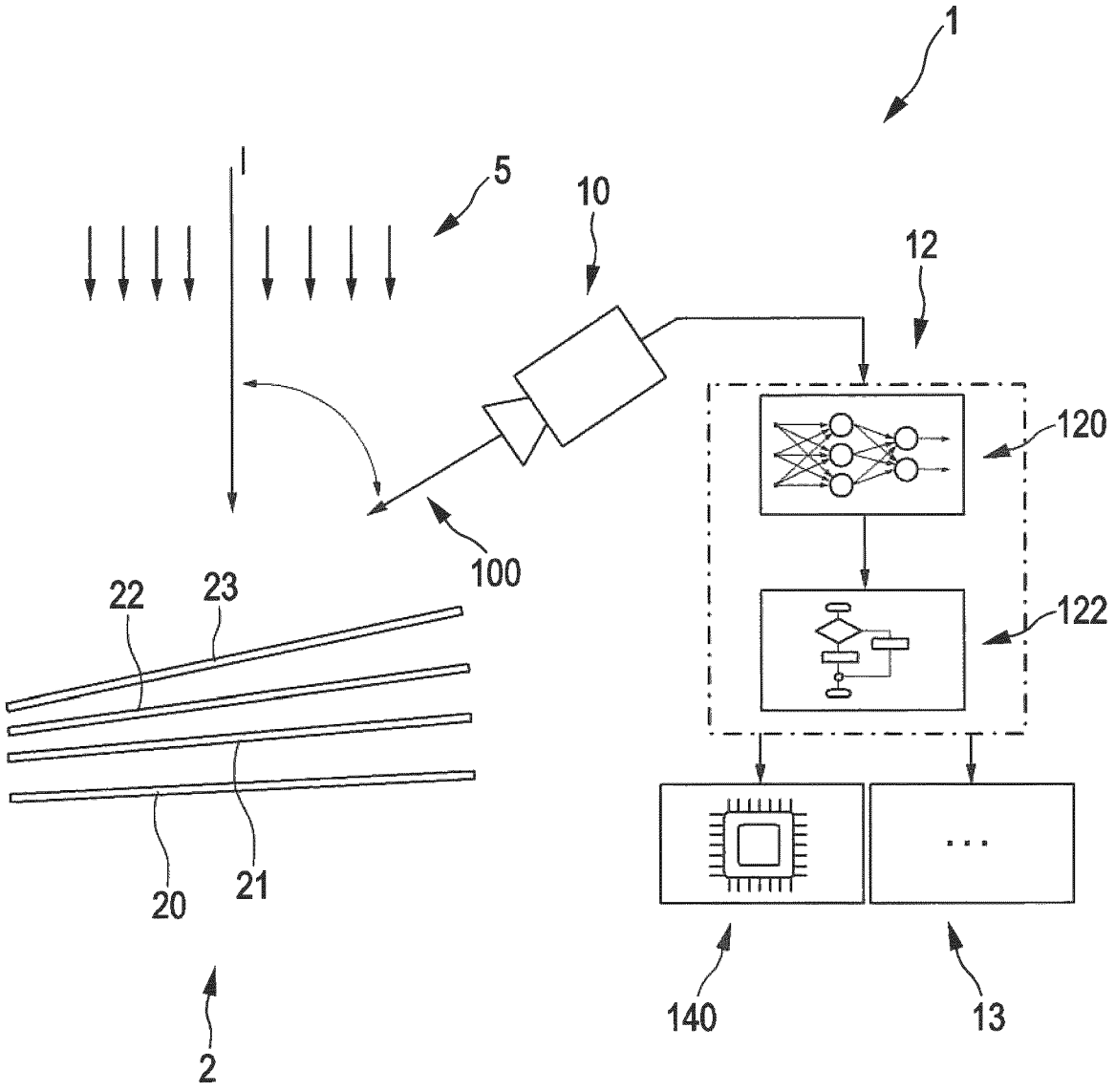
FIG. 1: shows schematically a device for monitoring a filling and/or closing installation and/or post-processing installation with an infeed region.

FIG. 1 shows schematically a device 1 for monitoring a filling and/or closing and/or post-processing installation, in particular for the pharmaceutical industry, comprising a transport, infeed and/or outfeed region 2. The transport, infeed and/or outfeed region 2 shown in FIG. 1 has a plurality of linearly running tracks 20, 21, 22, 23 along which primary packaging means, not shown in FIG. 1, in particular stoppers or filled or not yet filled containers, are conveyed. In other embodiments, instead of the tracks 20, 21, 22, 23, additional or other elements are provided by means of or along which the primary packaging means are conveyed, supplied or collected.

The shown device 1 for monitoring comprises a camera system 10 and a computing unit 12.

The camera system 10 is configured to take an image or a sequence of images of the transport, infeed and/or outfeed region 2. In the exemplary embodiment shown, an optical axis 100 of the camera system 10 is inclined with respect to a vertical axis I, the camera system 10 being arranged above the transport, infeed and/or outfeed region 2, offset from it in such a manner that a primary air supply 5 to the transport, infeed and/or outfeed region 2 from above, indicated schematically by arrows, is not disturbed by the camera system 10.

The computing unit 12 comprises an AI model 120 that is trained to detect primary packaging means in the transport, infeed and/or outfeed region 2 and to classify detected primary packaging means.

By means of the computing unit 12, an image taken by the camera system 10 can be analysed in order to determine on the basis of the image, by use of the AI model 120, in which image positions primary packaging means are present, and to assign detected primary packaging means to a class.

For classification of the primary packaging means, it is provided in an embodiment that different types of primary packaging means can be detected, with a class being allocated to each type. Alternatively or additionally, in an embodiment, primary packaging means of a type are classified on the basis of their orientation. In an embodiment, in this regard primary packaging means that are fed correctly oriented, overturned in the transport direction, overturned transversely to the transport direction, twisted and/or upside down are differentiated for classification.

The computing unit 12 shown further comprises a rule-based algorithm 122. The rule-based algorithm 122 is used, based on the output of the AI model 120, to determine whether there is a disturbance present.

In an embodiment, a determined disturbance is also classified, i.e. assigned to a class, with classes being defined in advance by an expert, according to the application. In an embodiment it is then determined, on the basis of the classification, how the determined disturbance is to be handled.

Additionally or alternatively, in an embodiment, the rule-based algorithm 122 is used to prioritise a determined disturbance, i.e. a priority value is assigned to the detected disturbance, with priority values for detected disturbances being defined in advance by an expert, according to the application. On the basis of the prioritisation, it is then determined in an embodiment whether and, if so, when the determined disturbance is to be handled. An objective of the prioritisation in this case is to avoid machine stoppages.

Depending on the specific application, class and/or priority value of the detected disturbance, appropriate measures can then be taken. In the exemplary embodiment shown, a transmission of the data to a memory unit 13 is provided, and information relating to the detected disturbance can be electronically logged in the memory unit 13.

In an embodiment, a signal is emitted to an operator by which signal the disturbance is communicated visually, acoustically and/or by other means to the operator. The operator can then take appropriate measures to handle the disturbance. In an embodiment, the disturbance is handled manually by the operator. In an embodiment, manual handling is effected in an isolator by means of gloved intervention.

In addition, in an embodiment, as shown schematically by a dashed arrow, data relating to the detected disturbance is transmitted to a machine controller 140. In an embodiment, the machine controller 140 in this case serves as an interface to a manipulator, not shown in FIG. 1, the manipulator being movable, by means of the machine controller 140, by means of an additional manipulator controller or by means of a manually operable controller, for the purpose of handling the determined disturbance.

Figure 2:
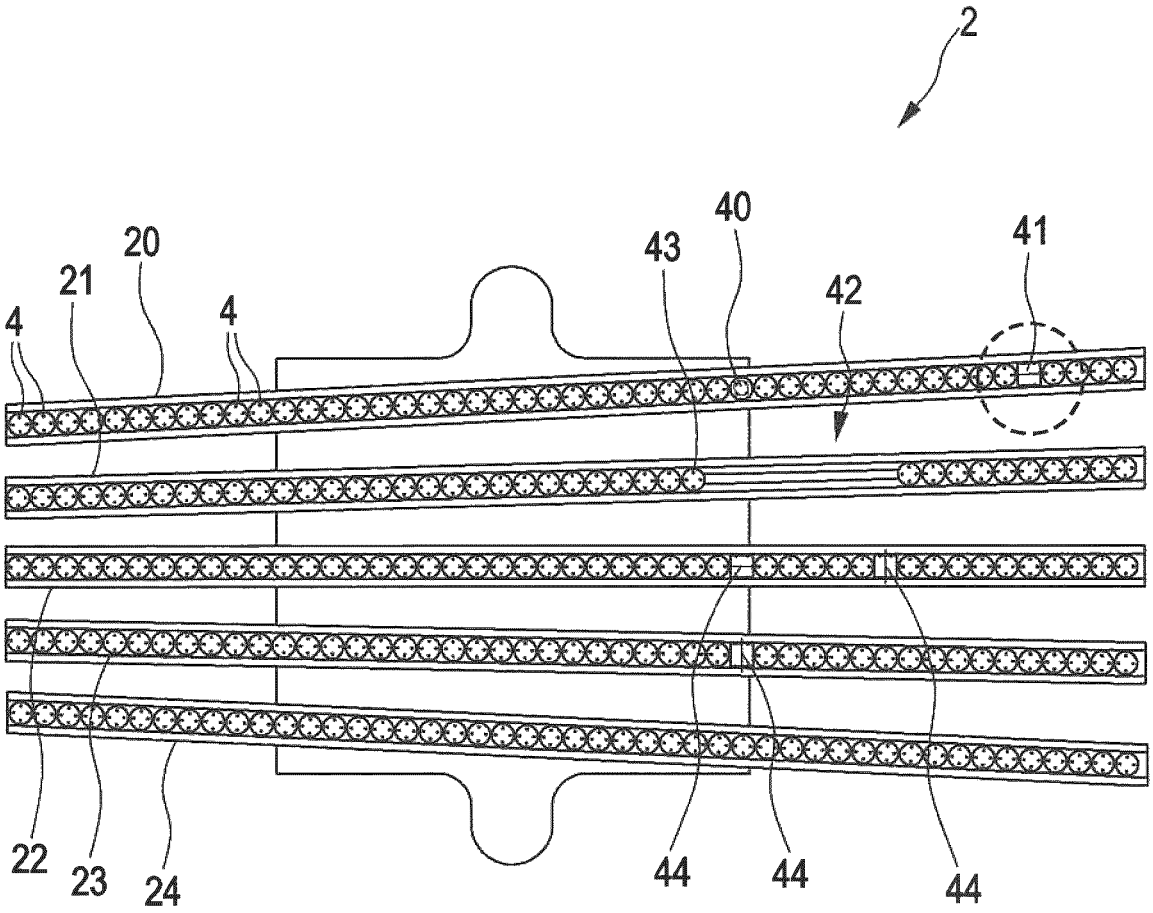
FIG. 2: shows schematically a filling and/or closing installation and/or post-processing installation with a plurality of disturbances.

FIG. 2 shows schematically an infeed region 2 that has a plurality of linearly running tracks 20, 21, 22, 23, 24 for primary packaging means 4 in the form of stoppers. The tracks 20, 21, 22, 23, 24 are each delimited laterally. The dimensions of the tracks 20, 21, 22, 23, 24 are selected so that the primary packaging means 4 can each be moved in succession along the tracks 20, 21, 22, 23, 24. In this case, a plurality of disturbances in the infeed region 2 are shown schematically in FIG. 2.

The disturbances shown are incorrectly oriented primary packaging means 40 and a gap 42, the gap 42 being caused, for example, by a primary packaging means 43 blocking movement in the track 20. In detail, shown in the uppermost track 20 (as viewed in the plane of the drawing), are a primary packaging means 40 that is rotated by 180° or fed-in upside down, and a primary packaging means 41 that is tilted in the direction of the path. A gap 42 is shown in the second track 21 from the top. Shown in the middle track 22 are a primary packaging means 41 overturned in the direction of the path, and a primary packaging means 44 oriented transversely to the direction of the path. A primary packaging means 40 oriented transversely to the direction of the path is likewise shown in the second track 23 from the bottom. The lowermost track 24 is completely correctly filled.

The primary packaging means 4, 40 present are detected by the computing unit 12 (cf. FIG. 1) by use of the AI model 120, and assigned to a class. The result can be output in a format suitable for further processing.

In an embodiment, an output of the AI model is subsequently evaluated by use of the rule-based algorithm 122 in order to determine disturbances, i.e. to determine incorrectly oriented primary packaging means 40, 41, 44 and/or to determine gaps 42.

In an embodiment, a determined disturbance is additionally classified and prioritised using the rule-based algorithm 122. In an embodiment, the rule-based algorithm 122 can be used to determine whether the disturbance is a gap 42, caused by a blockage, or an incorrectly oriented primary packaging means 40, 41, 44. Furthermore, when the primary packaging means are conveyed to the right in the plane of the drawing, in one exemplary embodiment the disturbance marked by a circle in FIG. 2 is assigned a higher priority value than other disturbances, since the incorrectly oriented primary packaging means 41 is fed to a subsequent processing step earlier than other incorrectly oriented primary packaging means 40, 41, 44, and rectification is therefore a priority. However, other prioritisations are also conceivable. For example, in an embodiment, the gap 42 is assigned a higher priority value than a defectively oriented primary packaging means 40, because of the blocking primary packaging means 43.

Figure 3:
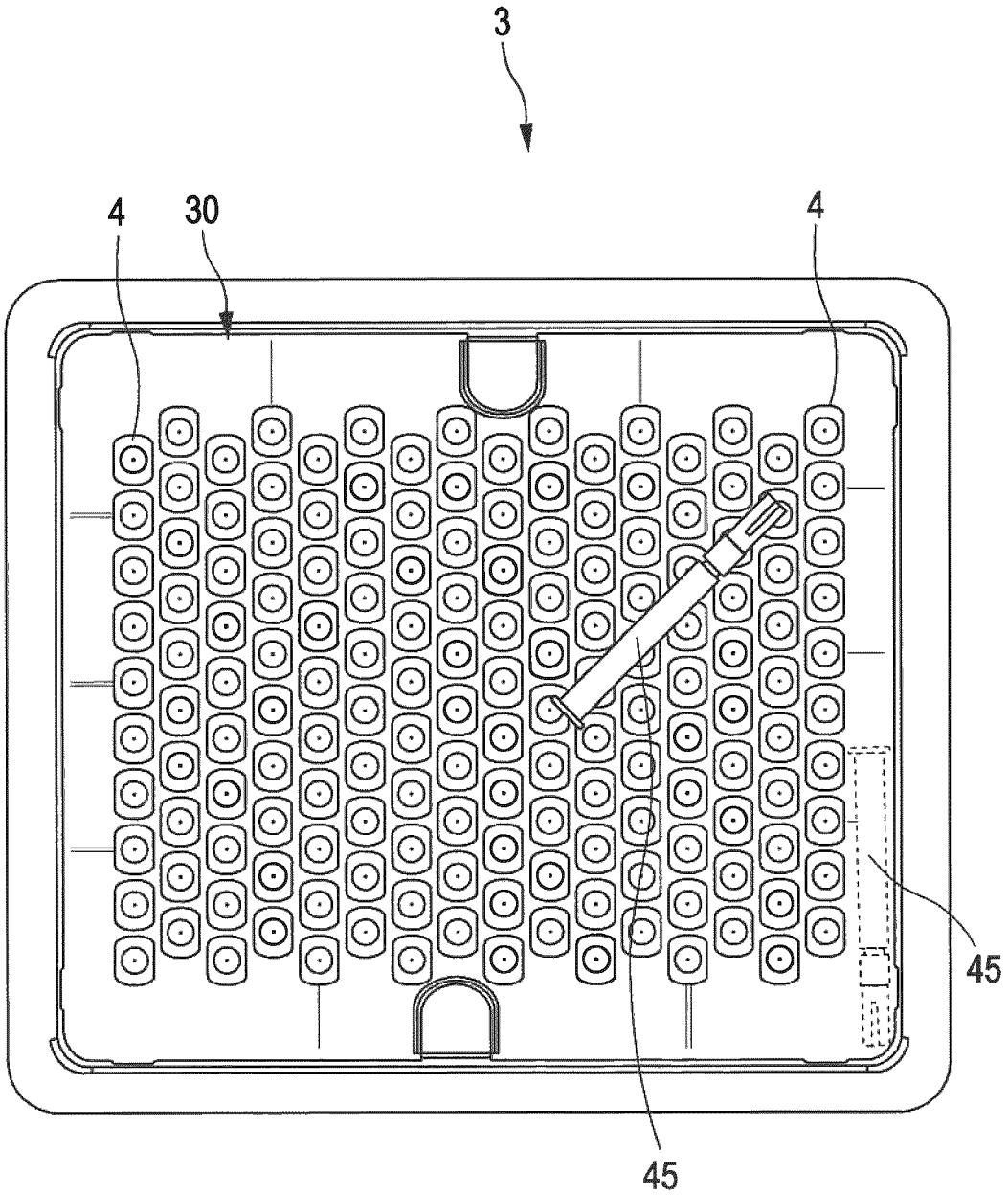
FIG. 3: shows schematically a nest in a transport, infeed and/or outfeed region of a filling and/or closing installation and/or post-processing installation with two disturbances.

FIG. 3 shows schematically a transport, infeed and/or outfeed region 3, comprising a nest 30 from which primary packaging means 4 are taken or into which primary packaging means 4 are placed, the primary packaging means 4 being provided or deposited in an ordered manner in a matrix. The primary packaging means 4 shown in FIG. 3 are syringes; in other embodiments other primary packaging means 4 are provided or deposited in nested form. In the case of the situation shown in FIG. 3, two disturbances are present, each disturbance being an overlying primary packaging means 45.

The disturbance due to the overlying primary packaging means 45 is detected in each case by the computing unit 12 (cf. FIG. 1) by use of the AI model 120 and the rule-based algorithm 122, and in an embodiment is additionally classified and prioritised using the rule-based algorithm 122. On the basis of the class assigned to the primary packaging means by the AI model, in an embodiment in this case it can be detected, using the rule-based algorithm 122, whether a disturbance has occurred, for example due to a missing primary packaging means or due to an overlying primary packaging means. In an embodiment in this case, operating states can be taken into account, i.e. the algorithm 122 can differentiate between a process-workflow-related empty space in the nest 30 and a disturbance-related empty space.

Figure 4:
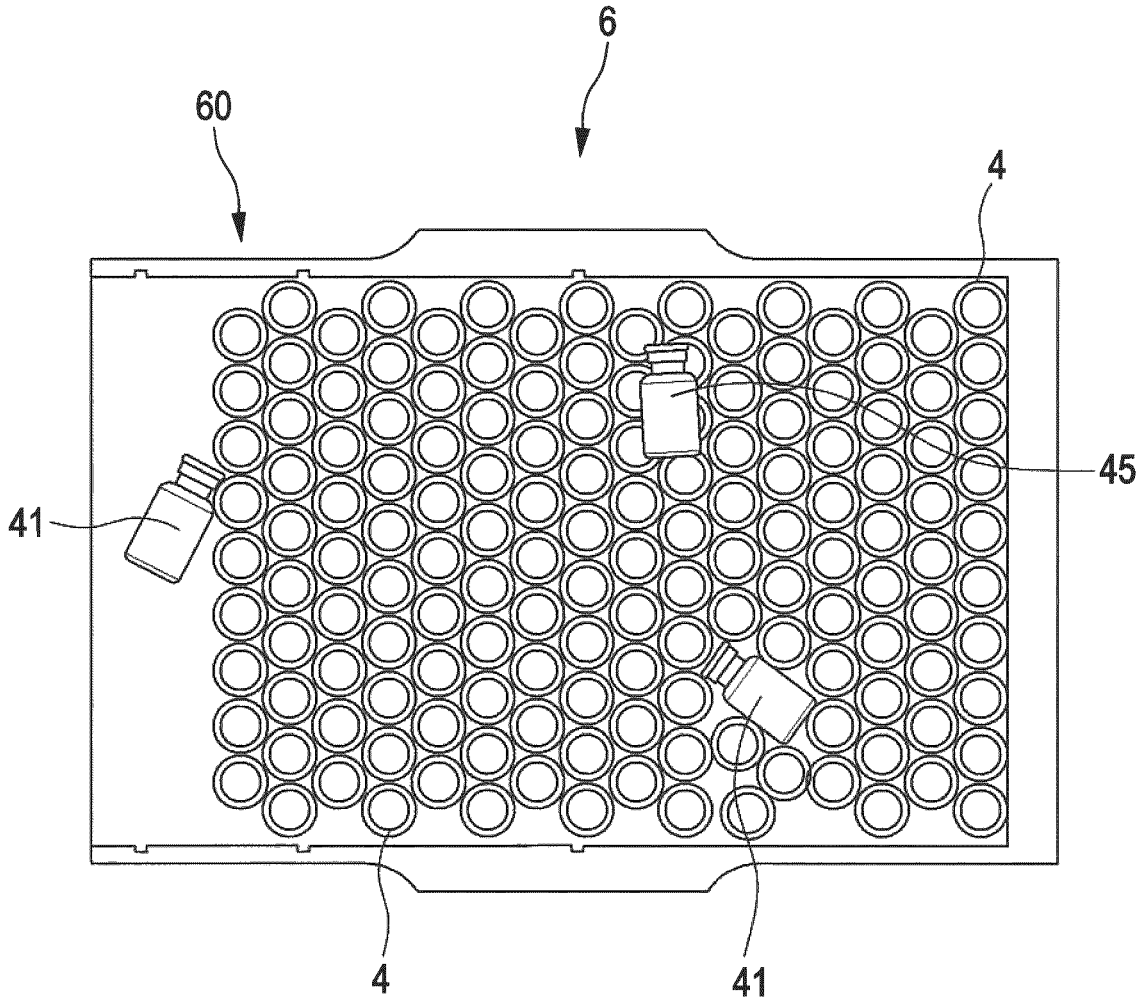
FIG. 4: shows schematically a tray in a transport, infeed and/or outfeed region of a filling and/or closing installation and/or post-processing installation with a plurality of disturbances.

FIG. 4 shows schematically a transport, infeed and/or outfeed region 6, comprising a spatially delimited tray 60 on which primary packaging means 4 are provided or deposited in an unordered manner in the exemplary embodiment shown. The primary packaging means 4 shown in FIG. 4 are containers in the form of vials; in other embodiments, other primary packaging means 4 are provided or deposited on a tray 60. In the case of the situation shown in FIG. 4, three disturbances are present, namely two overturned, and thus incorrectly oriented, primary packaging means 41, and one overlying primary packaging means 45.

The disturbances are detected by the computing unit 12 (cf. FIG. 1) by use of the AI model 120 and the rule-based algorithm 122, and in an embodiment are additionally classified and prioritised using the rule-based algorithm 122.

The disturbances shown in FIGS. 2 to 4 are for illustrative purposes only. As is obvious to the person skilled in the art, depending on the embodiment of the transport, infeed and/or outfeed region 2, 3, 6, additional and/or other disturbances may occur and/or fewer or more disturbances than those shown may occur at a point in time.

Figure 5:
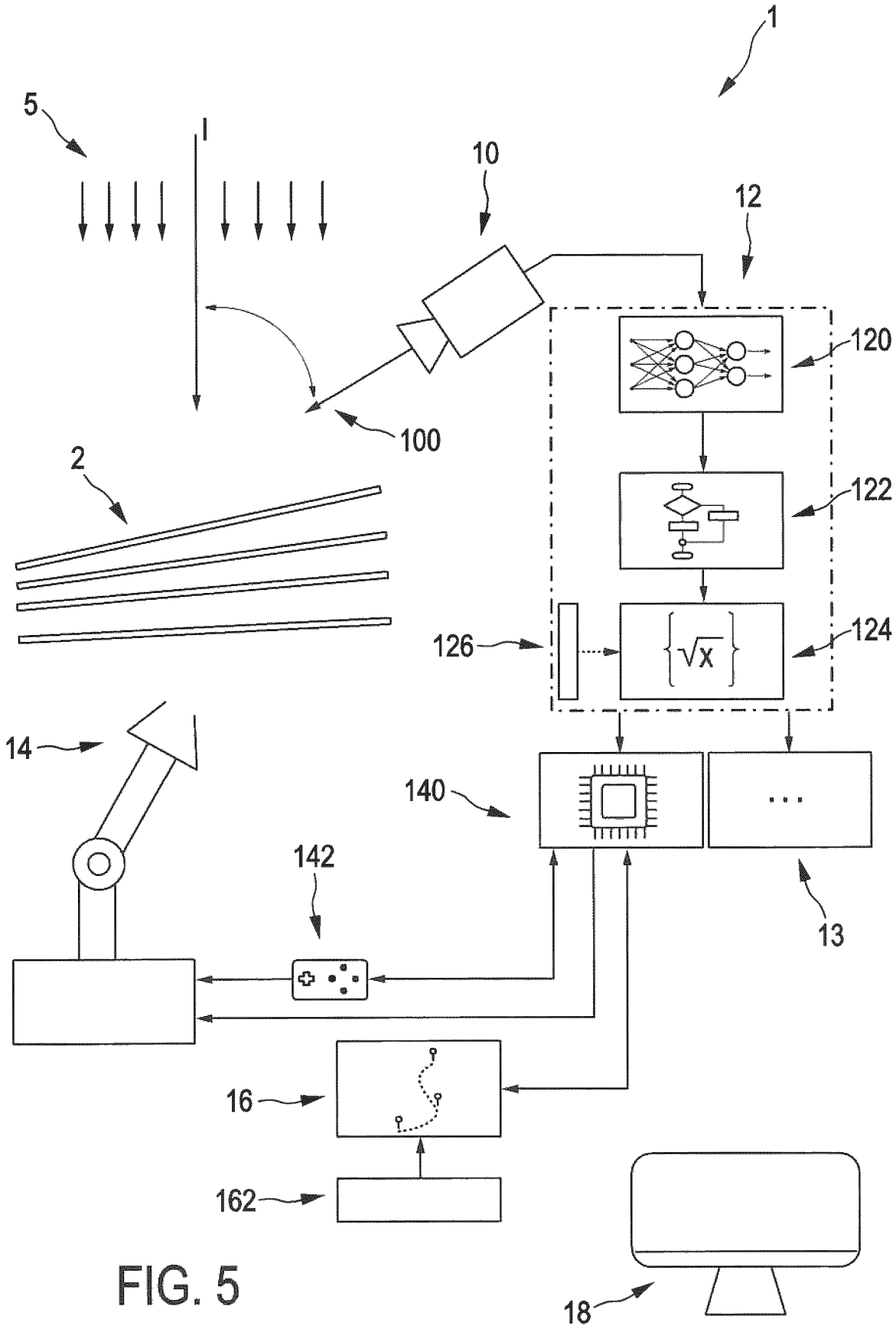
FIG. 5: shows schematically a device for determining and handling disturbances in a filling and/or closing installation and/or post-processing installation with an infeed region.

FIG. 5 shows schematically a device 1 for monitoring a filling and/or closing installation and/or post-processing installation, comprising a transport, infeed and/or outfeed region 2, using a camera system 10 and a computer unit 12 and for automated handling of a determined disturbance using a manipulator 14.

The camera system 10 is configured to take an image or a sequence of images of the transport, infeed and/or outfeed region 2. In the exemplary embodiment shown, an optical axis 100 of the camera system 10 is inclined with respect to a vertical axis I, the camera system 10 being arranged above the transport, infeed and/or outfeed region 2, offset from it in such a manner that a primary air supply 5 to the transport, infeed and/or outfeed region 2 from above, indicated schematically by arrows, is not disturbed by the camera system 10.

The computing unit 12 is configured to detect a disturbance on the basis of the image taken by the camera system, by use of an AI model 120 and using a rule-based algorithm 122. In an embodiment, it is additionally provided to classify the detected disturbance using the rule-based algorithm 122, i.e. to assign it to a class and to prioritise it, i.e. to assign a priority value to the determined disturbance.

The computing unit 12 is also configured to locate the disturbance, i.e. to identify a position of the determined disturbance in the transport, infeed and/or outfeed region 2. For this purpose, in the exemplary embodiment shown, on the basis of a coordinate transformation 124, the position of the disturbance detected in the image plane of the camera system 10 and the dimensions and orientation of the object to be manipulated in order to handle the disturbance, in particular a primary packaging means, are transformed into a coordinate system of the manipulator 14 and/or an operator using a suitable mathematical model 126.

In an embodiment, the transformed data of the position of the disturbance, as well as data relating to the primary packaging means concerned, such as its dimension and/or orientation, and—if available—a classification and/or prioritisation of the detected disturbance, are transmitted to a machine controller 140. In the exemplary embodiment shown, the machine controller 140 is in communication with a computing unit 16 that plans a path for a movement of the manipulator 14 to handle the disturbance, based on the data determined by the computing unit 12 and in consideration of interference contours 160. In the exemplary embodiment shown, the computing unit 16 is formed separately from the computing unit 12 of the monitoring system. In other embodiments, the computing units 12, 16 are formed together.

In an embodiment, a path along which the manipulator 14 is moved for collision-free handling of the determined disturbance is planned in such a way that travel paths of the manipulator 14 that influence the primary air supply 5 to the primary packaging means and/or to the components of the filling and/or closing installation and/or post-processing installation contacting the primary packaging means are minimised.

In an embodiment, the path is planned using an algorithm optimized for pharmaceutical compliance, wherein criteria for pharmaceutical compliance are in particular selected from a group comprising minimization of a time for which the manipulator is arranged above primary packaging means, minimization of a time for which the manipulator is arranged above components of the filling and/or closing installation and/or post-processing installation which are in contact with primary packaging means, flow optimization of a movement and/or speed profile, minimization of a rotation of axes of the manipulator, minimization of a movement of a handling system of the manipulator above the primary packaging means and/or the components of the filling and/or closing and/or post-processing installation which are in contact with primary packaging means, in particular minimization of a gripper movement above the primary packaging means, and minimization of an impact surface in the primary air supply.

The individual criteria in this case are to be weighted, or further criteria are to be added, depending on the application.

In the exemplary embodiment shown, a monitor 18 is also In the exemplary embodiment shown, a monitor 18 is also provided, which is part of the device 1 or is in communication therewith for data exchange. In an embodiment it is provided that a planned path can be visualized on the monitor 18 in a simulated environment. In other words, the monitor 18 shows a digital twin of the manipulator 14 and its real environment. In an embodiment, the planned path is visualized here on the monitor 18 before the movement of the manipulator 14 is carried out for interactive correction and/or approval. For a correction of the planned path, in an embodiment it is provided that the operator can change individual path points, wherein for this purpose in an embodiment a touch-sensitive monitor 18 is provided. Alternatively or additionally, for a correction in an embodiment, a repetition of the path planning using the computing unit 16 can be triggered by an operator without changing the criteria or their weighting. In other embodiments, it is possible for an operator to optionally repeat the path planning by changing the criteria and/or their weighting. In yet other embodiments, no operator interaction is necessary for approval of the planned path. In an embodiment, an evaluation of the quality of the planned path is performed, wherein no interaction of an operator is required if a defined threshold value is exceeded in the evaluation. In an embodiment, the path planning is first automatically repeated if the value drops below the threshold value, and an interaction of an operator is only required if the value drops below the threshold value again. Alternatively or additionally, a real movement of the manipulator is visualized on the monitor in the simulated environment.

In the exemplary embodiment shown, a manually operable control unit 142 is also provided, the manipulator 14 being movable by an operator using the controller 142 in order to handle a disturbance.

In an embodiment, the path along which the manipulator 14 is moved autonomously or using the controller 142 is electronically logged, in particular in the memory unit 13. Data to be logged relating to the path, the cause of a movement of the manipulator 14, primary packaging means moved using the manipulator or the like can be suitably specified in this case by a person skilled in the art, depending on the application. In an embodiment, the time period and/or the extent of coverage over which the manipulator was moved in the primary air supply 5 is logged. In an embodiment, the logged data comprise a video file of the movement visualised on the monitor 18, i.e. a video file of the digital twin. The video file allows an operator to easily evaluate the movement performed.

The exemplary embodiments shown are merely examples, and numerous variations are conceivable, it being determined on the basis of an image of a transport, infeed and/or outfeed region 2, 3, 6, by use of an AI model 120 that is trained to detect disturbances in the transport, infeed and/or outfeed region 2, 3, 6, whether there is a disturbance present in the transport, infeed and/or outfeed region 2, 3, 6.

In the case of a filling and/or closing installation and/or post-processing installation that has an isolator housing, in an embodiment the image in this case is taken using a camera system arranged in the isolator housing.

What is claimed is:

1. A method for monitoring a filling and/or closing and/or post-processing installation, wherein an image of a transport, infeed and/or outfeed region of the filling and/or closing and/or post-processing installation is taken using a camera system and, wherein on the basis of the image, by use of an artificial intelligence model (AI model) that is trained to detect primary packaging means in the transport, infeed and/or outfeed region and to classify detected primary packaging means, it is determined in which image positions primary packaging means are present, and detected primary packaging means are assigned to a class, wherein the camera system is arranged above the transport, infeed and/or outfeed region, offset from the transport, infeed and/or outfeed region in such a manner that a primary air supply to the transport, infeed and/or outfeed region is not disturbed by the camera system, an optical axis of the camera system being inclined with respect to a vertical axis.

2. The method according to claim 1, wherein a determined disturbance is handled using a manipulator, the manipulator being movable by means of a machine controller, by means of a decentralized manipulator controller and/or by means of a manually operable controller for the purpose of handling the determined disturbance.

3. The method according to claim 1, wherein the method for monitoring the filling and/or closing and/or post-processing installation is for the pharmaceutical industry.

4. The method according to claim 1, wherein it is specified the method comprises to specify on the basis of the classification how the determined disturbance is handled and/or specified to specify on the basis of a prioritization whether—and if so, when—the determined disturbance is handled.

5. The method according to claim 1, wherein an output of the AI model is evaluated by use of a rule-based algorithm for the purpose of determining disturbances, and a determined disturbance is classified and/or prioritised prioritized.

6. The device according to claim 1, wherein the computing unit is configured to evaluate an output of the AI model by use of a rule-based algorithm for the purpose of determining disturbances, and to classify and/or prioritize a determined disturbance by use of the rule-based algorithm.

7. The method according to claim 1, wherein primary packaging means are classified on the basis of their type, and/or primary packaging means of a type are classified on the basis of their orientation.

8. The method according to claim 1, wherein an output of the AI model is evaluated by use of a rule-based algorithm for the purpose of determining disturbances.

9. The method according to claim 1, wherein a position of a determined disturbance in at least one of the infeed region, the transport region and the outfield region is identified.

10. The method according to claim 1, wherein the infeed region having a transport means and/or sorting means, and/or at least one of the infeed region, the transport region and the outfield region at which primary packaging means are provided or deposited in an unordered manner or ordered in a matrix, is monitored.

11. A device for monitoring a filling and/or closing installation and/or post-processing installation, comprising a camera system configured to take an image of a transport, infeed and/or outfeed region of the filling and/or closing installation and/or post-processing installation, and a computing unit comprising an artificial intelligence model (AI model) that is trained to detect primary packaging means in the transport, infeed and/or outfeed region and to classify detected primary packaging means, the computing unit being configured to determine on the basis of the image, by use of the AI model, in which image positions primary packaging means are present, and to assign detected primary packaging means to a class, wherein an optical axis of the camera system is inclined with respect to a vertical axis, such that the camera system can be arranged above the transport, infeed and/or outfeed region, offset from the monitored transport, infeed and/or outfeed region in such a manner that a primary air supply to the transport, infeed and/or outfeed region is not disturbed.

12. The device according to claim 11, wherein a manipulator is provided, which is configured to handle a determined disturbance by means of a central machine controller, a decentralised manipulator controller and/or by means of a manually operable controller.

13. The device according to claim 11, wherein the device for monitoring the filling and/or closing installation and/or post-processing installation is for the pharmaceutical industry.

14. The device according to claim 11, wherein the computing unit is configured to specify, on the basis of a classification, how the determined disturbance is to be handled, and/or to specify, on the basis of a, prioritization whether, and if so, when, the determined disturbance is to be handled.

15. The device according to claim 11, further comprising a memory unit that is configured to electronically log information related to the detected disturbance.

16. The device according to claim 11, wherein that the AI model is trained to classify primary packaging means on the basis of their type, and/or primary packaging means of a type on the basis of their orientation.

17. The device according to claim 11, wherein the computing unit is configured to evaluate an output of the AI model by use of a rule-based algorithm for the purpose of determining disturbances.

18. A filling and/or closing installation and/or post-processing installation, the installation comprising a transport, infeed and/or outfeed region and a device for monitoring, the device comprising a camera system configured to take an image of said transport, infeed and/or outfeed region of the filling and/or closing installation and/or post-processing installation, and a computing unit comprising an artificial intelligence model (AI model) that is trained to detect primary packaging means in the transport, infeed and/or outfeed region and to classify detected primary packaging means, the computing unit being configured to determine on the basis of the image, by use of the AI model, in which image positions primary packaging means are present, and to assign detected primary packaging means to a class, the filling and/or closing installation and/or post-processing installation comprising an isolator housing in which the transport, infeed and/or outfeed region is arranged.

19. The filling and/or closing installation and/or post-processing installation according to claim 18, wherein a manipulator is provided, which is configured to handle a determined disturbance by means of a central machine controller, a decentralised manipulator controller and/or by means of a manually operable controller.

20. A tangible, non-transitory computer-readable medium comprising program instructions that are executable by one or more processors such that one or more processors are configured to determine, on the basis of an image of an infeed of a filling and/or closing and/or post-processing installation, by use of an artificial intelligence model (AI model) that is trained to detect primary packaging means in the infeed and to classify detected primary packaging means, in which image positions primary packaging means are present, and to assign detected primary packaging means to a class;

the filling and/or closing installation and/or post-processing installation comprising an isolator housing in which the transport, infeed and/or outfeed region is arranged.

21. The tangible, non-transitory computer-readable medium according to claim 20, wherein the program instructions are executable by the one or more processors such that one or more processors are further configured to determine, on the basis of an output of the AI model, by use of a rule-based algorithm, whether there is a disturbance present.

* * * * *